US008633642B2

(12) United States Patent
Poczik et al.

(10) Patent No.: US 8,633,642 B2
(45) Date of Patent: Jan. 21, 2014

(54) LAMP PART FIXING BY SHAPE MEMORY ALLOY IN THE DISCHARGE TUBE OF FLUORESCENT LAMPS

(75) Inventors: Peter Ivan Poczik, Budapest (HU); Peter Mora, Budapest (HU); Peter Lucz, Budapest (HU); Balazs Torok, Budapest (HU)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/297,816

(22) Filed: Nov. 16, 2011

(65) Prior Publication Data

US 2013/0119855 A1 May 16, 2013

(51) Int. Cl.
*H01J 1/62* (2006.01)
*H01J 63/04* (2006.01)

(52) U.S. Cl.
USPC ..... 313/490; 313/553

(58) Field of Classification Search
USPC ..... 313/25–27, 111–117, 317, 313/318.01–318.09, 483–493, 567–577, 313/623, 627–643; 439/615, 739; 445/22, 445/24, 26, 29
See application file for complete search history.

(56) References Cited

U.S. PATENT DOCUMENTS

| | | | | |
|---|---|---|---|---|
| 3,634,717 | A * | 1/1972 | Boucher et al. | 313/552 |
| 5,717,290 | A * | 2/1998 | Shaffer | 313/545 |
| 2006/0145608 | A1 * | 7/2006 | De Man et al. | 313/552 |
| 2009/0309482 | A1 * | 12/2009 | Srivastava et al. | 313/487 |

FOREIGN PATENT DOCUMENTS

JP 5225908 * 3/1993 ..... H01J 65/04

OTHER PUBLICATIONS

U.S. Appl. No. 12/795,917, filed Dec. 8, 2011, Peter Lucz, et al.

* cited by examiner

*Primary Examiner* — Donald Raleigh
(74) *Attorney, Agent, or Firm* — Fay Sharpe LLP

(57) ABSTRACT

The present disclosure relates to a lamp part fixing device and method for lamp components made of shape memory alloy. The device includes a main body that carries, for example, a main or auxiliary amalgam, getter, etc. located at a desired position within a discharge tube of a fluorescent lamp. For example, the amalgam can be advantageously located at pre-selected axial locations and/or within a diffusion path. The main body is configurable between a first configuration and a second configuration. The first configuration allows the mount to move within the discharge tube when the shape memory alloy is below an alloy transition temperature. The second configuration of the main body allows for controlled placement and immobilization of the device within the discharge tube when the shape memory alloy is raised above the alloy transition temperature. The device is shaped in a generally planar or non-planar configuration.

15 Claims, 10 Drawing Sheets

LAMP PART FIXING BY SHAPE MEMORY ALLOY IN THE DISCHARGE TUBE OF FLUORESCENT LAMPS

BACKGROUND OF THE DISCLOSURE

The present disclosure relates to a device and method for fixing a lamp part or component in the discharge tube of fluorescent lamps. This disclosure will have particular application with lamp parts or components made from shape memory alloys.

Lamps, and in particular fluorescent lamps or compact fluorescent lamps, include discharge tubes that contain a fill gas and related materials or lamp parts in a discharge space. Applying an electric potential provided by electrodes generates an arc and continued discharge therebetween to provide desired illumination. In many cases lamp elements such as mercury sources, getters, etc. need to be fixed inside the lamp. For example, positioning of a mercury source or mercury sources such as a main amalgam and/or auxiliary amalgam in the lamp affects lamp performance and thermal behavior. Fluorescent lamps that are dosed with an amalgam containing mercury have a long warm-up time. That is, the warm-up time is generally defined as that time period (measured from start-up or ignition) to reach 80% of a stabilized lumen output. Auxiliary amalgams are typically positioned on lead wires or mounts in order to reduce the warm-up time (see, for example, commonly owned U.S. Ser. No. 12/795,917, filed Jun. 8, 2010). The effect of the auxiliary amalgam on the warm-up time is limited, however, by the diffusion of mercury from the auxiliary amalgam into the discharge space. Diffusion lengths need to be reduced to improve the warm-up time decreasing effect of auxiliary amalgams. Incorporating additional auxiliary amalgams into the discharge space can decrease the diffusion length and the warm-up time. However, positioning amalgam sources at controlled locations in the discharge space, and assuring that the high-temperature amount comes in thermally controlled amalgam containers are accurately and effectively located where desired, are often difficult.

Accordingly, a need exists to improve positioning of amalgam sources, and likewise fixing other lamp components such as getters at desired locations within the discharge space. Similarly, there exists a need to provide a device and a method for reducing the length of diffusion of a fluorescent lamp without negatively affecting the quality or consistency of lamp illumination. Further, there exists a need for an efficient way to accurately position and immobilize auxiliary amalgams on mounts within a discharge lamp at a desired position to decrease diffusion length and warm-up time.

SUMMARY OF THE DISCLOSURE

A lamp part fixing device and method for fixing lamp parts or lamp components made of shape memory alloy is disclosed.

The device or fixing member includes a main body that is dosed with an amalgam to be located within a discharge tube of a fluorescent lamp and to position amalgam within a diffusion path. The main body is configurable between a first configuration and a second configuration. The first configuration allows the mount to move within the discharge tube when the shape memory alloy is below an alloy transition temperature. The second configuration of the main body allows for controlled placement and immobilization of the mount within the discharge tube when the shape memory alloy is raised above the alloy transition temperature.

In one embodiment, the lamp part fixing device includes a main body having a base member attached to at least one articulating member, the base member and articulating member are disposed in a first orientation or first configuration at a first temperature. The base member and the articulating member adopt a second orientation or configuration when the fixing device is raised above a second temperature (transition temperature) different than the first temperature.

The articulating member preferably re-orients relative to the base member when the device is in the second configuration. The base member and articulating member abut an inner surface of the discharge tube and immobilize the device at a desired position within the discharge tube.

In another embodiment, the lamp part fixing device includes a non-planar main body extending along a portion of a circumference. The non-planar main body is disposed between a first end and a second end. The first end is spaced from the second end along the circumference when the device is in the first configuration and the first end is spaced further from the second end along the circumference when the device is in the second configuration. An outer surface of the non-planar body abuts the inner surface of the discharge tube positioning the device at a desired position within the discharge tube in the second configuration. The non-planar body is optionally a continuous panel or wire-shaped to be positioned and immobilized in the discharge tube.

In yet another embodiment, the lamp part fixing device includes a coiled body having a plurality of turns including a first diameter in the first configuration and a different, second diameter in the second configuration such that the second diameter is greater than the first diameter. In the second configuration, an outer surface of the coiled body abuts the inner surface of the discharge tube to maintain the device at a desired location within the discharge tube.

In a further embodiment, a method of immobilizing lamp components made of shape memory alloy within a discharge tube of a lamp includes the steps of arranging a lamp component into a first configuration. The lamp component is positioned within the discharge tube of the lamp and subsequently heated so that the component adopts a second configuration to firmly abut an inside surface of the discharge tube. The lamp component is configured into the second configuration by heating the lamp component to a temperature above an alloy transition temperature.

An advantage of the present disclosure is a device that efficiently fixes or immobilizes a lamp part or component, such as mercury sources in the form of main and auxiliary amalgams, or getters, in the discharge tube at one or more desired locations in the lamp.

Another advantage of the disclosure is the ability to easily, quickly, and accurately fix the lamp part in the discharge lamp.

Still another advantage resides in the wide variety of configurations that may be used.

Yet another benefit is associated with the ability to fix the lamp part in the discharge tube by heating the shape memory alloy holder above a transition temperature.

Still other advantages and benefits of the present disclosure will become more apparent upon reading and understanding the following detailed description.

DETAILED DESCRIPTION OF THE PREFERRED EMBODIMENTS

Figure 1A:
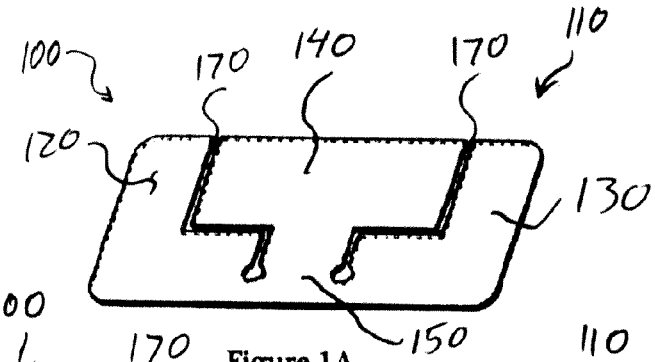
FIG. 1A is a perspective view of a first embodiment of a lamp part fixing device in a first configuration.
Figure 1B:
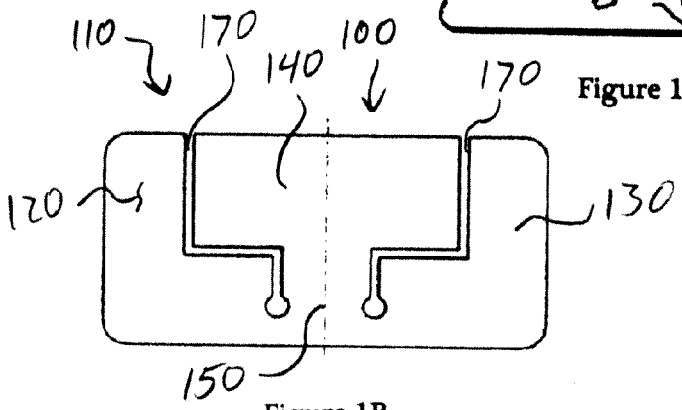
FIG. 1B is a front view of the first embodiment of the lamp part fixing device in the first configuration.
Figure 1C:
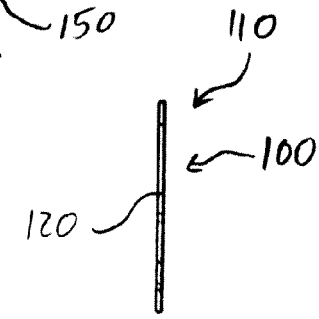
FIG. 1C is a side view of the first embodiment of the lamp part fixing device in the first configuration.

A device and method are provided to improve the performance of discharge tubes in fluorescent lamps, including compact fluorescent lamps. The device is made from shape memory alloy and can be used in any type of discharge tube having a confined discharge space. The device and method are particularly useful to improve the performance characteristics and manufacturing efficiency of a discharge tube in a fluorescent lamp.

Shape memory alloy is a material that is generally known in the art, for example, three known shape memory alloys include copper-zinc-aluminum-nickel, copper-aluminum-nickel, and nickel-titanium alloys, although these identified materials should not be deemed limiting. Shape memory alloys return to an original or pre-deformed shape by increasing the temperature of the material above a transition temperature. After the shape memory alloy temperature exceeds the transition temperature, the alloy reverts to the original pre-deformed shape.

Further, shape memory alloys can be configured to include one-way or two-way shape memory effects. The one-way shape memory effect refers to a material that once deformed (e.g. bending or stretching) in a cold state or first configuration, will hold that first shape or first configuration until the material is heated above a transition temperature. Once the material is raised above the transition temperature, then the material reverts to a second configuration (actually, the original shape) and will remain in the second configuration once the material cools.

The two-way shape memory effect allows the alloy to actuate between a first shape/configuration and a second shape/configuration as its temperature is fluctuated above and below the transition temperature. The present disclosure may include the one-way effect and/or the two-way effect type of shape memory alloy material.

The device or mount includes a body that advantageously positions or locates an amalgam (either a main amalgam and/or an auxiliary amalgam) within a discharge tube of a fluorescent lamp, for example, positioning the amalgam within the diffusion path such that the warm-up time is improved.

As shown in FIGS. 1A-3, a first embodiment of a lamp part fixing device 110 is illustrated in both a first configuration 100 and a second configuration 200. The device 110 of this arrangement includes a generally rectangular-shaped main body 120 (although other peripheral shapes may be used) sized or dimensioned for receipt into a discharge tube 125 (FIG. 2C). The main body 120 includes a first or base member 130 and second or an articulating member 140 arranged in a thin planar shape in the first configuration. The articulating member 140 is connected to the base member 130 preferably along a hinge 150. In this embodiment, the base member 130, articulating member 140, and hinge 150 are made from a continuous portion of shape memory alloy that is configured to actuate from the first or substantially planar configuration 100 of FIGS. 1A-1C to the second configuration or deployed configuration 200 (FIGS. 2A-2C and 3). The main body 120 includes gaps 170 between edges of the base member 130 and articulating member 140 such that the articulating member is attached to the base member 130 along hinge 150 and free to move relative to the base member once the transition temperature of the shape memory alloy is exceeded.

In the first configuration 100, the base member 130 and the articulating member 140 of the main body 120 are aligned along a common plane that has a generally rectangular perimeter shape. The device 110 is sized to be freely moveable within the discharge tube 125, and, as one skilled in the art will appreciate, the minor dimension of the generally rectangular shape is preferably less than an inner diameter dimension of the discharge tube. In the second configuration 200, the articulating member 140 is angled from the base member 130 such that a portion of the base member 130 and articulating member 140 abut an inner surface 160 of the discharge tube 125 with a generally circular-shaped cross-sectional area (FIGS. 2C and 3).

Figure 2A:
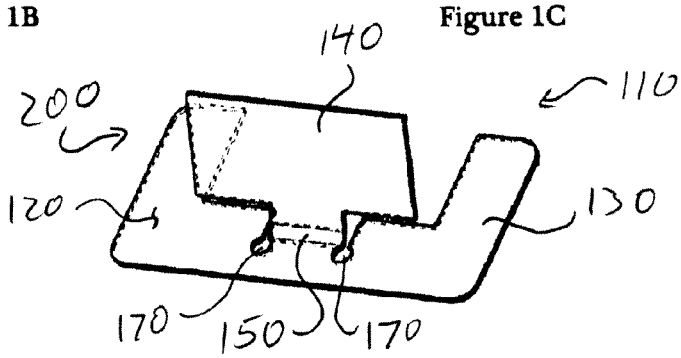
FIG. 2A is a perspective view of the first embodiment of the lamp part fixing device in a second configuration.
Figure 2B:
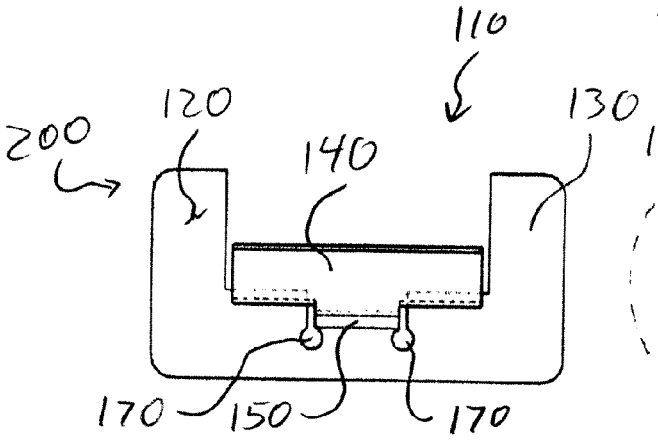
FIG. 2B is a front view of the first embodiment of the lamp part fixing device in the second configuration.
Figure 2C:
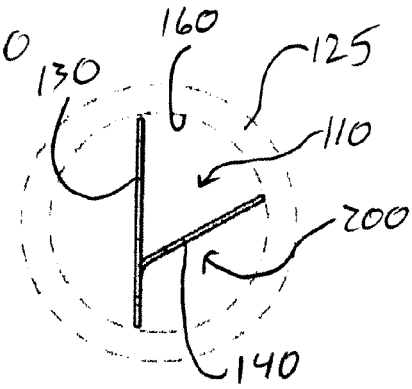
FIG. 2C is a side view of the first embodiment of the lamp part fixing device in the second configuration within a discharge tube.
Figure 3:
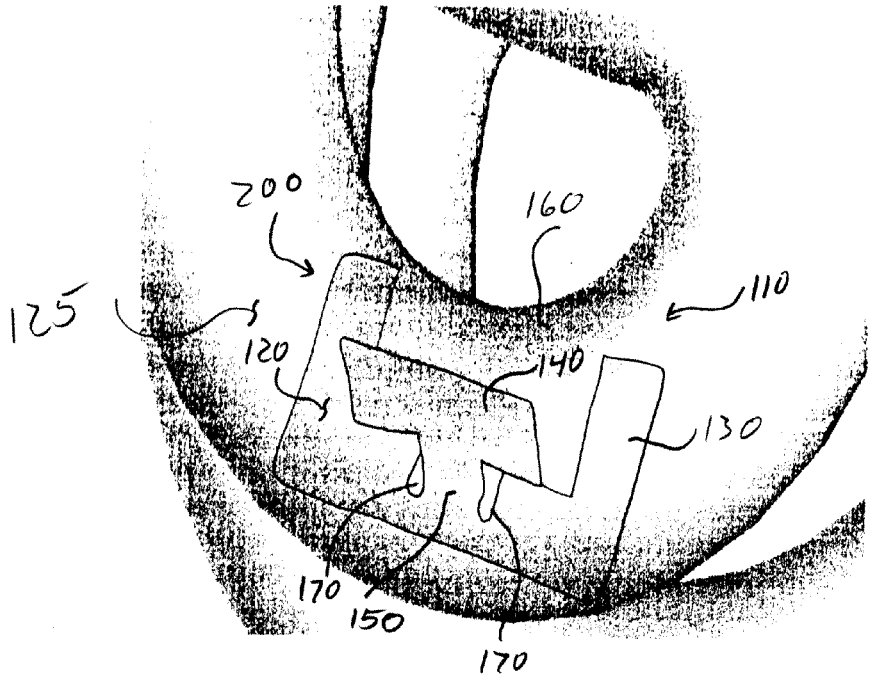
FIG. 3 is a perspective view of the first embodiment of the lamp part fixing device in the second configuration within the discharge tube.
Figure 4A:
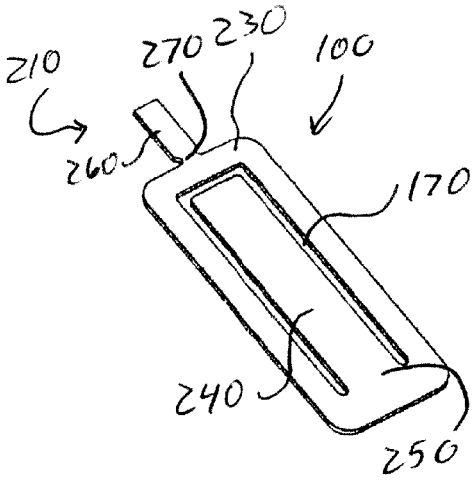
FIG. 4A is a perspective view of a second embodiment of the lamp part fixing device in the first configuration.
Figure 4B:
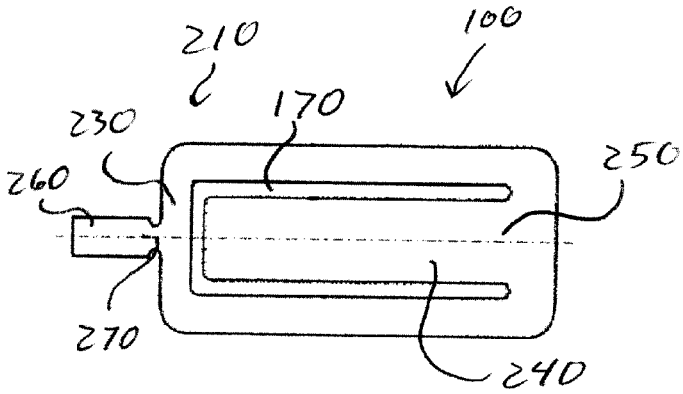
FIG. 4B is a front view of the second embodiment of the lamp part fixing device in the first configuration.

FIGS. 2C and 3 illustrate one embodiment of the device 110 in the second configuration 200 as the device is immobilized within the discharge tube 125. The device 110 is first positioned at a location within the discharge tube 125 while in the first configuration 100. When the device 110 is located at the desired position, the temperature of the device is raised above the transition temperature of the shape memory alloy, i.e., heat is introduced to increase the temperature of the device mount 110 so that the device exceeds the transition temperature, and the desired deformation (from the first configuration to the second configuration) occurs. In this embodiment, it is predetermined that the deformation occurs at or along hinge 150. It should be noted that other embodiments of the device 110 can be configured to actuate or deform at a different, desired location on the device 110 that would be advantageous to be positioned and immobilized within a discharge tube of various dimensions.

As shown in FIGS. 4A-6B, three different embodiments of the present disclosure are illustrated in the first configuration 100. Particularly, in FIGS. 4A and 4B, a generally rectangular-shaped device 210 includes an articulating member 240 that deflects or actuates along hinge 250 into the second configuration 200 when the shape memory alloy is raised above the transition temperature. The articulating member 240 has an elongated arrangement and preferably extends from the base member 230 along hinge 250 disposed adjacent one end. Additionally, device 210 includes a protrusion or extension portion 260 extending from base member 230 from a second hinge 270 disposed along an end, shown here as an end opposite or spaced from the hinge 250. The protrusion 260 is configured to move or actuate along the second hinge 270 from the first configuration 100 to a second configuration 200 spaced at an angle relative to the base member. In the first configuration 100, the protrusion 260, base member 230 and articulating member 240 are positioned generally along the same plane. In the second configuration 200, the protrusion 260 and articulating member 240 are angled or spaced from the common plane of base member 230 in order to abuttingly engage with an inner surface of the discharge tube and secure the device (and the lamp component, e.g., getter, main or auxiliary amalgam carried thereby) at a desired location in the discharge tube.

The hinge 250 and second hinge 270 are disposed at predetermined locations so that when the shape memory alloy of the device is raised above the transition temperature thereof, the articulating member 240 and the protrusion 260 adopt a non-planar position relative to the base member 230. In one embodiment, hinge 250 and second hinge 270 have different transition temperatures. More particularly, protrusion 260 is shaped to extend past gap 170 when in the second configuration 200 and may abut the articulating member 240, remaining in the first configuration 100, such that the articulating member 240 is restricted from actuating. In other instances, one portion initially deploys to its second configuration at a lower transition temperature and then the second portion subsequently deploys to the second configuration at a higher transition temperature.

Figure 5A:
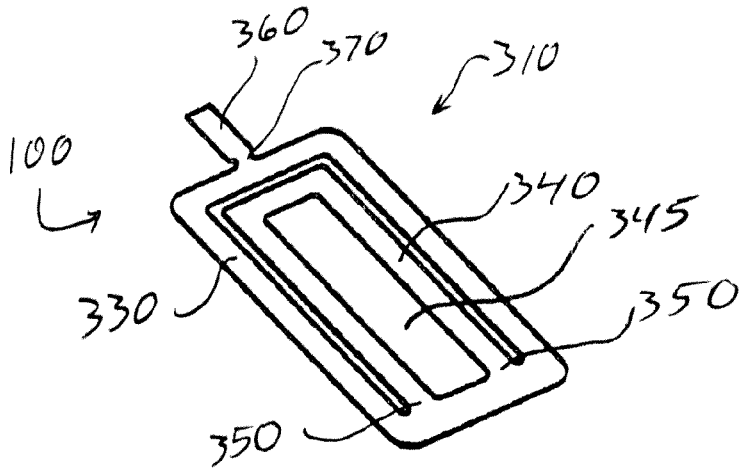
FIG. 5A is a perspective view of a third embodiment of the lamp part fixing device in the first configuration.
Figure 5B:
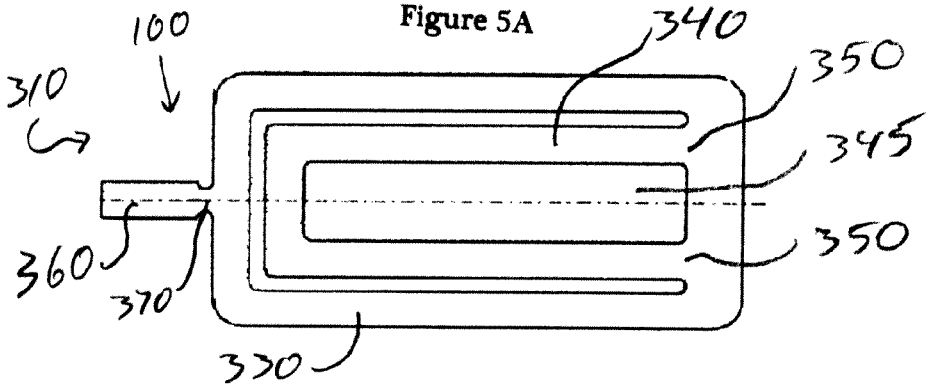
FIG. 5B is a front view of the third embodiment of the lamp part fixing device in the first configuration.

In a third embodiment shown in FIGS. 5A and 5B, device 310 includes a substantially rectangular, planar shape in the first configuration 100 having an articulating member 340 attached to the base member 330 along two hinges 350 shown in spaced relation adjacent one end of the device. A protrusion 360 is attached to the base member 330 at a second hinge 370 which is preferably located adjacent a second or opposite end of the device. The articulating member 340 has an inner opening or space 345.

Figure 6A:
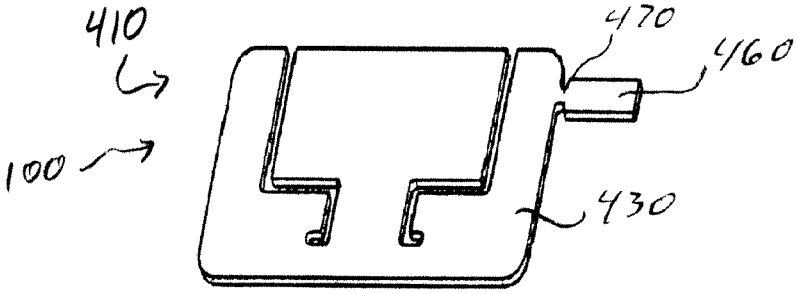
FIG. 6A is a perspective view of a fourth embodiment of the lamp part fixing device in the first configuration.
Figure 6B:
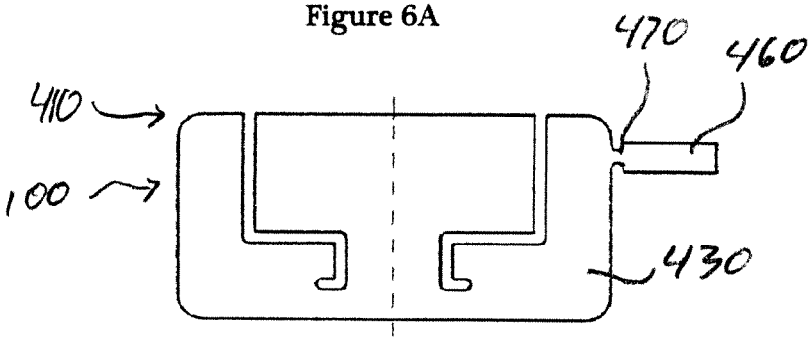
FIG. 6B is a front view of the fourth embodiment of the lamp part fixing device in the first configuration.

In a fourth embodiment of FIGS. 6A and 6B, device 410 is shown in the first configuration 100 and has a substantially similar arrangement to device 110 of FIGS. 1-3. In addition, device 410 includes a protrusion 460 attached to base member 430 along a second hinge 470. As one skilled in the art will appreciate, the use of separate actuating members (e.g., central portion 440 and protrusion 460) provides greater flexibility in design and functionality, and may also allow the separate actuating members to deploy at different transition temperatures if so desired.

Figure 7B:
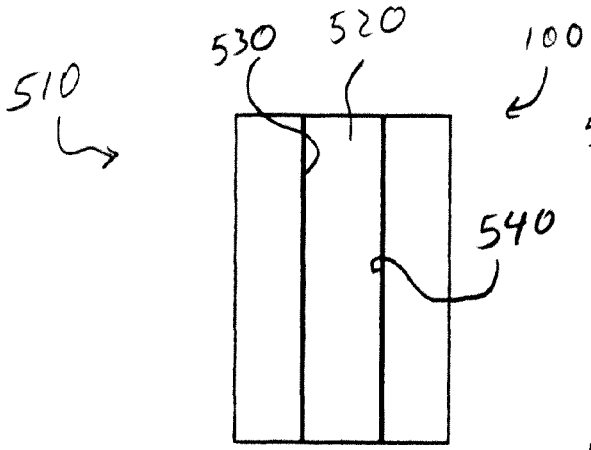
FIG. 7B is a top view of the fifth embodiment of the lamp part fixing device in the first configuration.
Figure 7A:
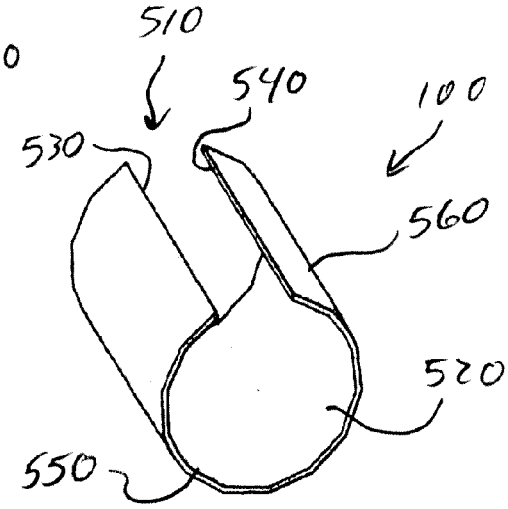
FIG. 7A is a perspective view of a fifth embodiment of the lamp part fixing device in the first configuration.
Figure 7C:
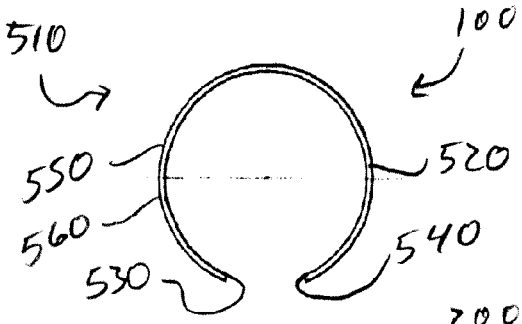
FIG. 7C is a side view of the fifth embodiment of the lamp part fixing device in the first configuration.

In a fifth embodiment as shown in FIGS. 7A-8C, device 510 includes an arcuate body 520 in a first configuration (FIG. 7A) that allows the device to be inserted into an inner diameter of a discharge tube, for example. The arcuate body 520 is a continuous rectangular panel in a generally non-planar orientation. The device 510 includes a first edge or end 530 and a second edge or end 540 that are radially spaced apart and located generally along a circumference 550. FIGS. 7A-7C illustrates the arcuate body 520 of device 510 in the first configuration 100 such that the first end 530 and the second end 540 are in relatively close spatial position and the size of circumference 550 is preferably less than an inner surface 160 of the discharge tube 125.

Figure 8B:
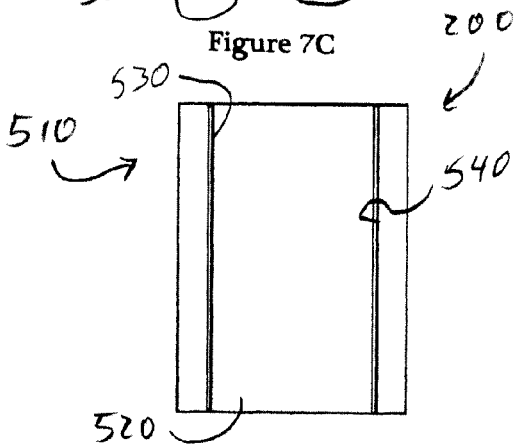
FIG. 8B is a top view of the fifth embodiment of the lamp part fixing device in the second configuration.
Figure 8A:
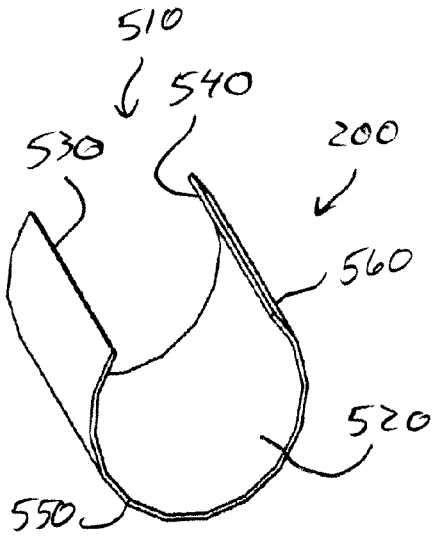
FIG. 8A is a perspective view of the fifth embodiment of the lamp part fixing device in the second configuration.
Figure 8C:
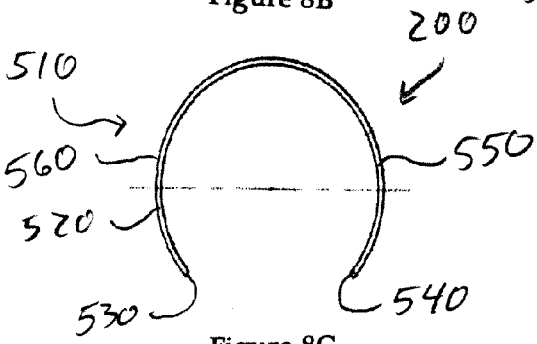
FIG. 8C is a side view of the fifth embodiment of the lamp part fixing device in the second configuration.

FIGS. 8A-8C illustrate the arcuate body 520 of device 510 in the second configuration 200 such that the first end 530 and the second end 540 are spaced further apart and the size of the circumference 550 (or cross-sectional dimension/diameter) is increased. In the second configuration 200 of device 510, an outer side 560 of the arcuate body 520 abuts the inner surface 160 of the discharge tube 125 along circumference 550 to immobilize the device 510 within the discharge tube.

In a sixth embodiment as shown in FIGS. 9A-10C, a device 610 includes an arcuate body 620 made of a continuous wire in a first, generally non-planar orientation. The device 610 includes a first edge or end 630 and a second edge or end 640 that are radially spaced apart and located along a circumference 650 when viewed endwise (FIG. 9C). The continuous wire is configured into a first rib 635 and a second rib 645 that are axially or longitudinally spaced apart along a common axis 655 and are each attached to the first end 630 and second end 640. The first end 630 and second ends 640 are shaped as axially extending arms interposed between the first rib 635 and second rib 645.

Figure 9B:
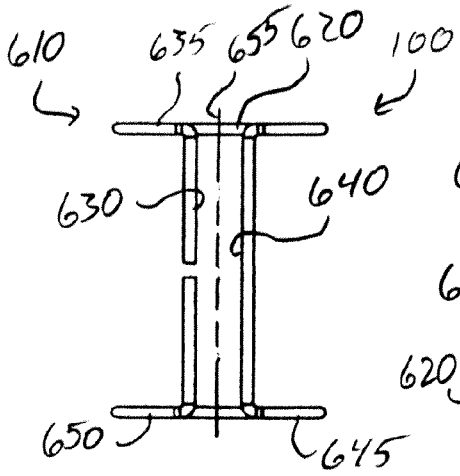
FIG. 9B is a top view of the sixth embodiment of the lamp part fixing device in the first configuration.
Figure 9A:
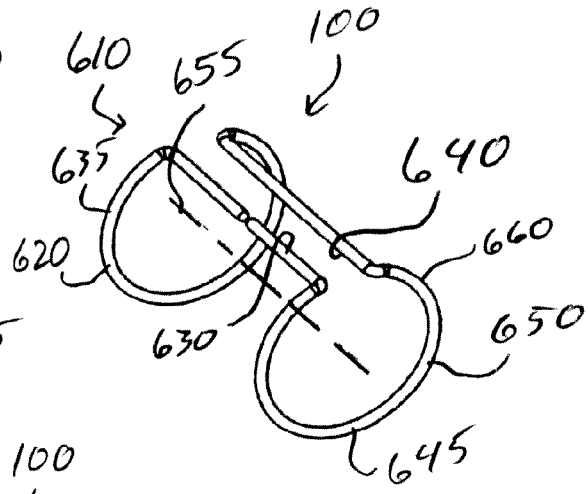
FIG. 9A is a perspective view of a sixth embodiment of the lamp part fixing device in the first configuration.
Figure 9C:
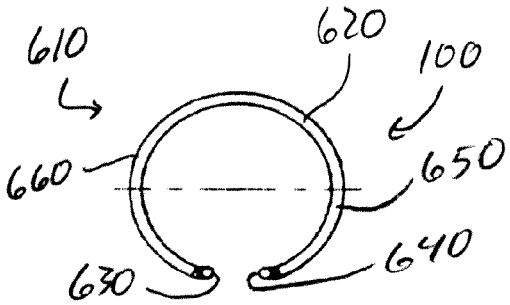
FIG. 9C is a side view of the sixth embodiment of the lamp part fixing device in the first configuration.
Figure 10B:
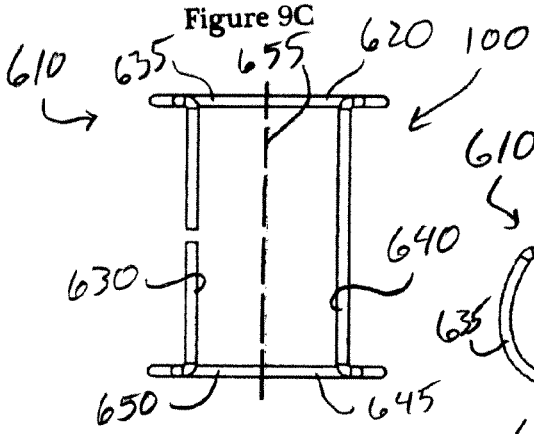
FIG. 10B is a top view of the sixth embodiment of the lamp part fixing device in the second configuration.
Figure 10A:
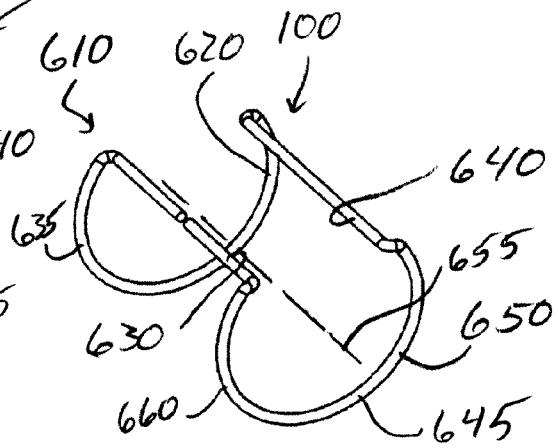
FIG. 10A is a perspective view of the sixth embodiment of the lamp part fixing device in the second configuration.
Figure 10C:
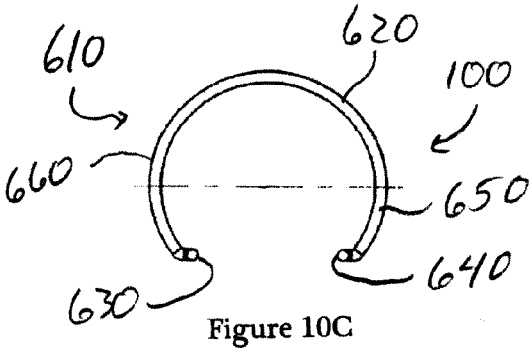
FIG. 10C is a side view of the sixth embodiment of the lamp part fixing device in the second configuration.

FIGS. 9A-9C illustrate the device 610 in the first configuration 100 such that the first end 630 and the second end 640 are in close spatial position and the circumference 650 is sized for dimensional receipt within the discharge tube 125. FIGS. 10A-10C illustrates the device 610 in the second configuration 200 such that the first end 630 is spaced further apart from the second end 640 and the size (diametrical dimension) of the device is increased. In the second configuration 200 of device 610, an outer edge 660 of the continuous wire abuts the inner surface 160 of the discharge tube 125 along the circumference 650 to immobilize the device 610 and fix the device and lamp component carried thereby (not shown), at a desired location within the discharge tube.

In a seventh embodiment as shown in FIGS. 11A-12C, device 710 includes an arcuate body 720 also made of a continuous wire in a generally non-planar orientation in the first configuration. The device 710 includes a first, axially extending edge or end 730 and a second, axially extending end 740 that are radially spaced apart and located along a circumference 750. The continuous wire is configured into a plurality of spaced apart generally ring portions or ribs 735, more preferably four ribs 735. The ribs 735 are axially spaced from each other along a common, longitudinal axis 755 and are formed into portions of the first end 730 and second end 740. The portions of the first and second ends 730, 740 are shaped as arms connected between each of the plurality of ribs 735.

Figure 11B:
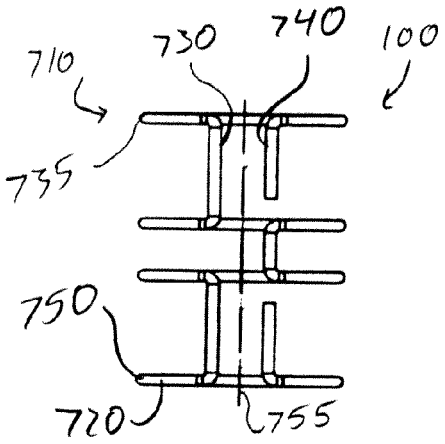
FIG. 11B is a top view of the seventh embodiment of the lamp part fixing device in the first configuration.
Figure 11A:
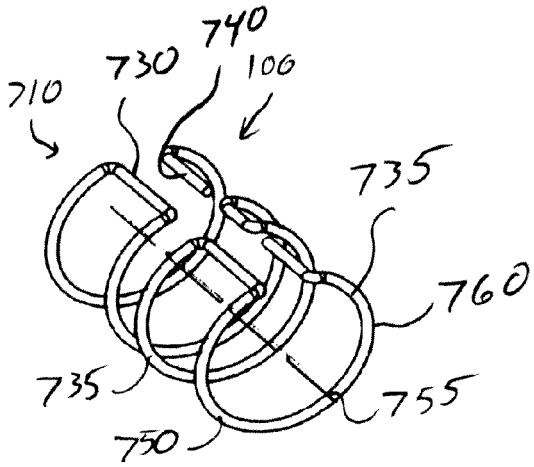
FIG. 11A is a perspective view of a seventh embodiment of the lamp part fixing device in the first configuration.
Figure 11C:
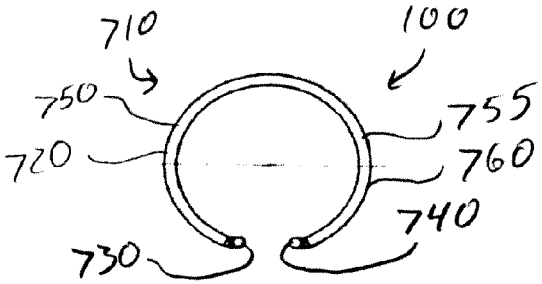
FIG. 11C is a side view of the seventh embodiment of the lamp part fixing device in the first configuration.
Figure 12B:
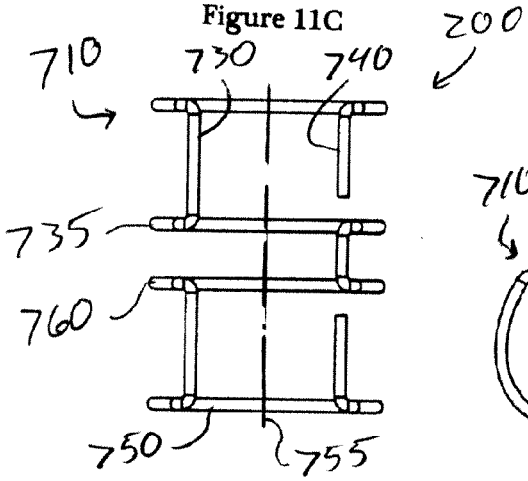
FIG. 12B is a top view of the seventh embodiment of the lamp part fixing device in the second configuration.
Figure 12A:
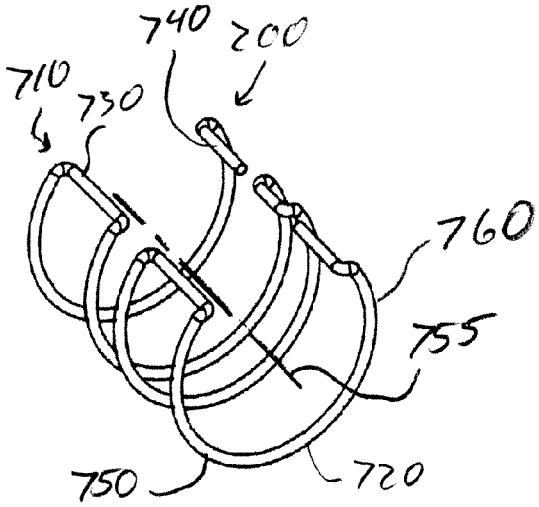
FIG. 12A is a perspective view of the seventh embodiment of the lamp part fixing device in the second configuration.
Figure 12C:
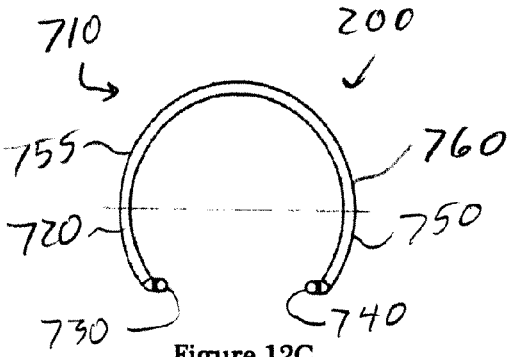
FIG. 12C is a side view of the seventh embodiment of the lamp part fixing device in the second configuration.
Figure 13A:
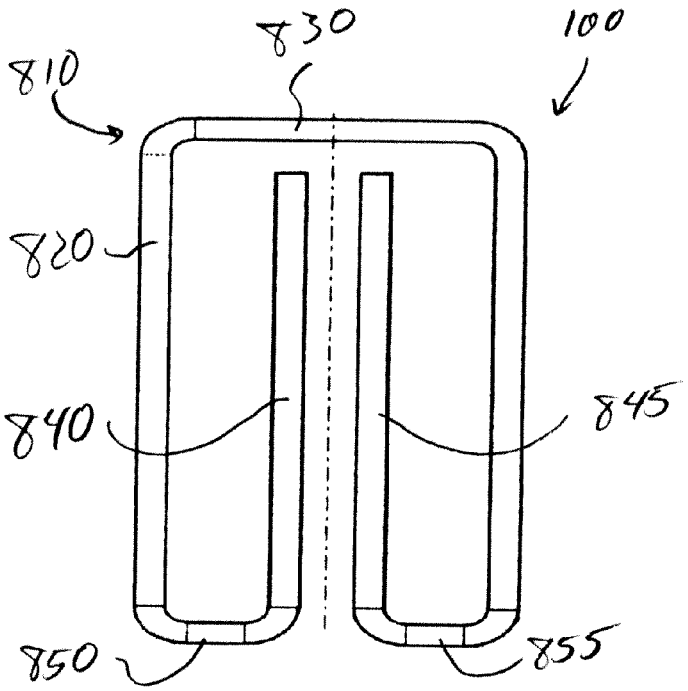
FIG. 13A is a front view of an eighth embodiment of the lamp part fixing device in the first configuration.
Figure 13B:
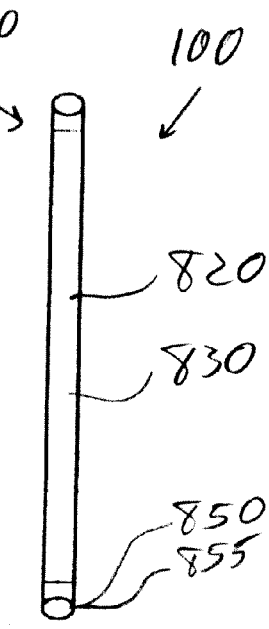
FIG. 13B is a side view of the eighth embodiment of the lamp part fixing device in the first configuration.

FIGS. 11A-11C illustrate the device 710 in the first configuration 100 such that the first end 730 and the second end 740 are in close spatial position and the outer diameter or outer circumference 750 sized to movably slide within the associated discharge tube 125. FIGS. 12A-12C, on the other hand, illustrate the device 710 in the second configuration 200 such that the first end 730 is spaced further apart from the second end 740 than in the first configuration 100 and the size of the diameter/circumference 750 is increased. In the second configuration 200 of device 710, an outer edge(s) 760 of the continuous wire abuts the inner surface 160 of the discharge tube 125 along the circumference 750 to immobilize the device 710.

Figure 14A:
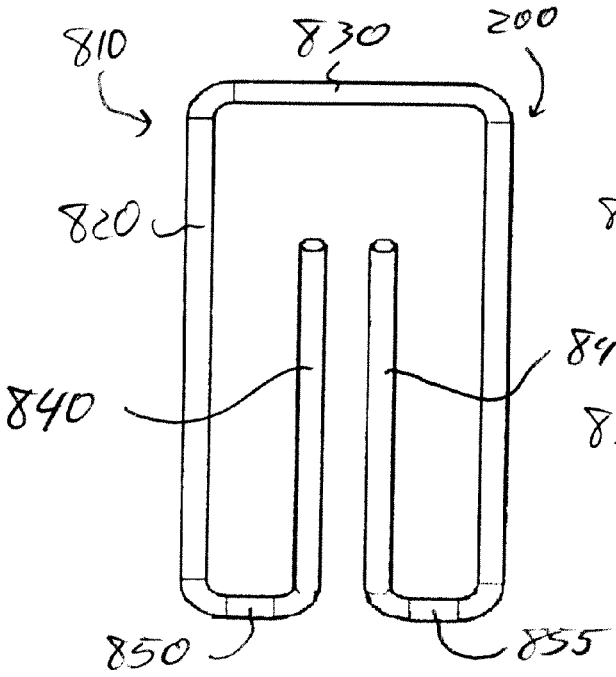
FIG. 14A is a front view of the eighth embodiment of the lamp part fixing device in the second configuration.
Figure 14B:
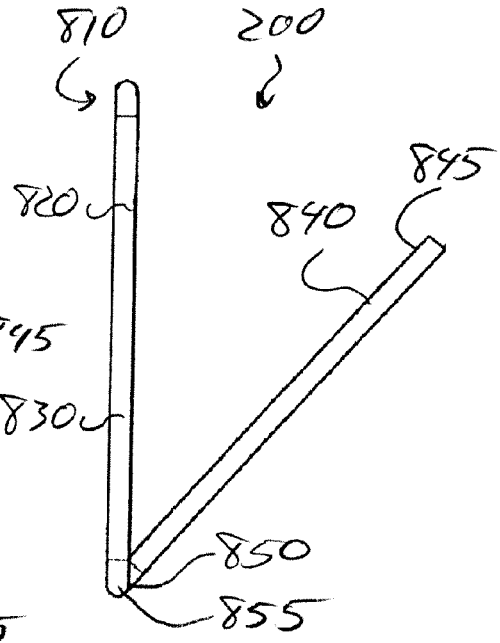
FIG. 14B is a side view of the eighth embodiment of the lamp part fixing device in the second configuration.
Figure 15A:
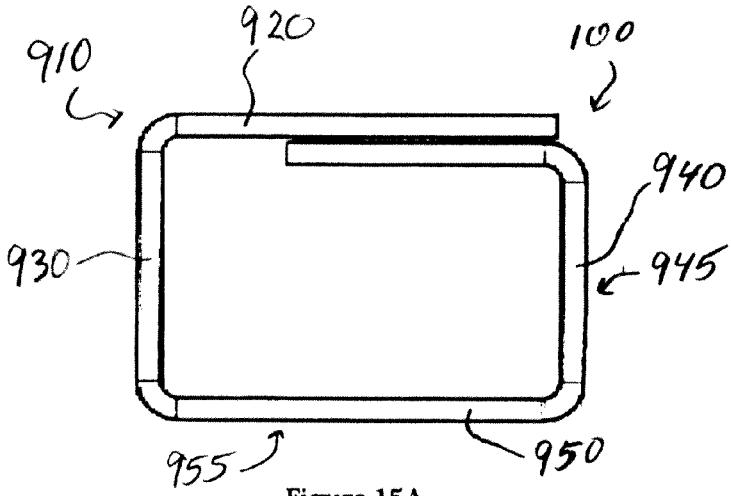
FIG. 15A is a front view of a ninth embodiment of the lamp part fixing device in the first configuration.
Figure 15B:
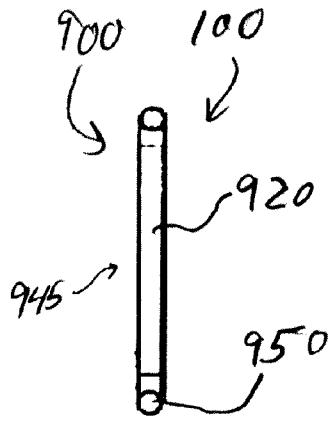
FIG. 15B is a side view of the ninth embodiment of the lamp part fixing device in the first configuration.

In an eighth embodiment shown in FIGS. 13A-14B, device 810 is illustrated in both a first configuration 100 (FIGS. 13A-B) and a second configuration 200 (FIGS. 14A-B). The wire-like device 810 has a generally rectangular-shaped main body perimeter 820 that is dimensioned for receipt within a discharge tube 125. The main body 820 preferably includes a base member 830 and a pair of articulating members 840, 845 arranged in a thin rectangular shape. The articulating members 840, 845 extend from the base member 830 along a pair of hinges 850, 855. In this embodiment, the base member 830, articulating members 840, 845 and hinges 850, 855 are made from a continuous wire made of one or more shape memory alloy(s) that is configured to actuate from the first configuration 100 to the second configuration 200. In the first configuration 100, the base member 830 and the articulating members 840, 845 are generally aligned along a common plane in a generally rectangular perimeter shape. The device 810 is sized to be freely moveable within the discharge tube 125.

In the second configuration 200 (FIGS. 14A-B), the articulating members 840, 845 are spaced in non-planar relation (i.e., generally angled) from the base member 830 such that peripheral portions of the base member 830 and articulating members 840, 845 preferably abut an inner surface 160 of the discharge tube 125. This is similar to one or more of the embodiments of FIGS. 1-6. The hinges 850, 855 are separately actuated such that articulating members 840, 845 are spaced from the base member 830 in the same direction or optionally from opposing sides of the base member 830 if so desired. Likewise, if the device is made entirely of the same shape memory alloy, then the articulating members 840, 845 would deploy at approximately the same time, i.e., when the transition temperature is reached. Alternatively, different portions of the device can be made of different shape memory alloy so that the articulating members move from the first configuration to the second configuration at different transition temperatures if so desired.

Figure 16A:
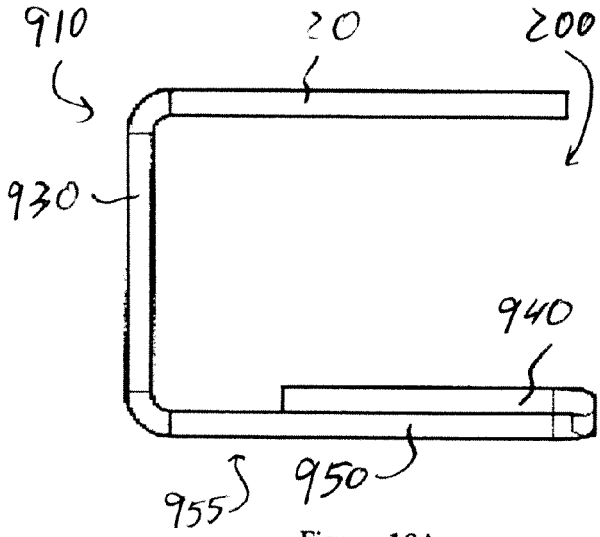
FIG. 16A is a front view of the ninth embodiment of the lamp part fixing device in the second configuration.
Figure 16B:
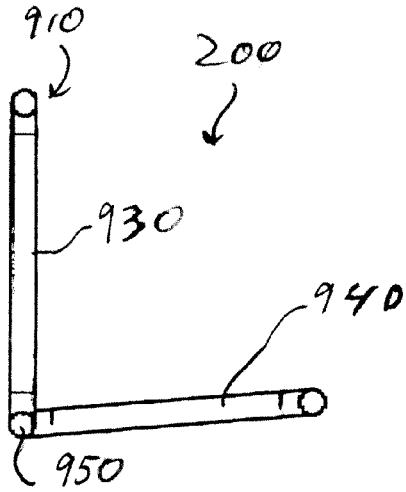
FIG. 16B is a side view of the ninth embodiment of the lamp part fixing device in the second configuration.
Figure 17A:
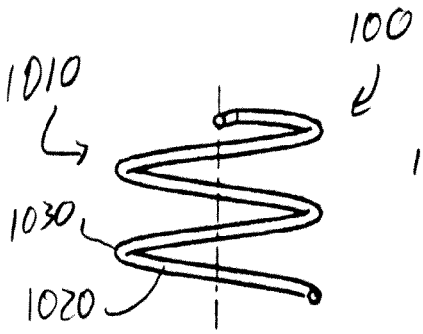
FIG. 17A is a front view of a tenth embodiment of the lamp part fixing device in the first configuration.
Figure 17B:
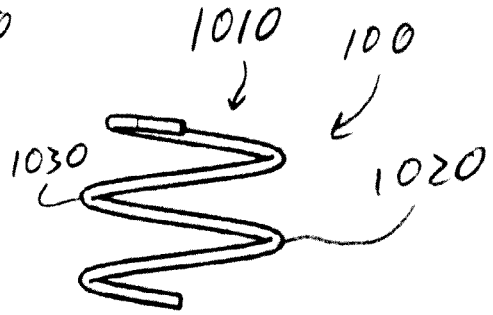
FIG. 17B is a side view of the tenth embodiment of the lamp part fixing device in the first configuration.
Figure 17C:
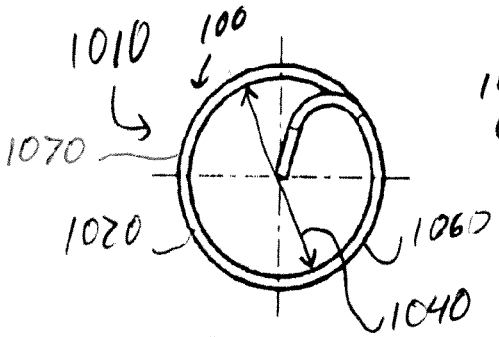
FIG. 17C is a top view of the tenth embodiment of the lamp part fixing device in the first configuration.
Figure 17D:
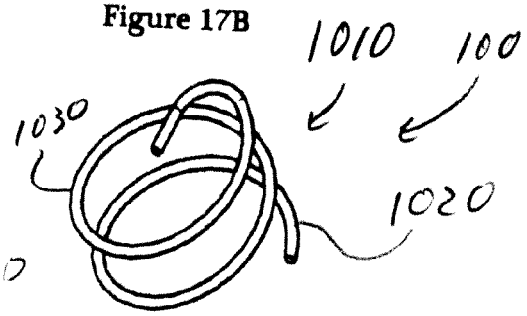
FIG. 17D is a perspective view of the tenth embodiment of the lamp part fixing device in the first configuration.
Figure 18A:
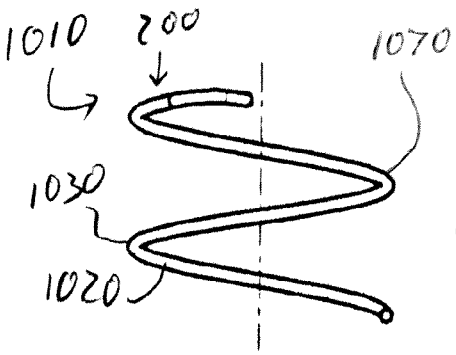
FIG. 18A is a front view of the tenth embodiment of the lamp part fixing device in the second configuration.
Figure 18B:
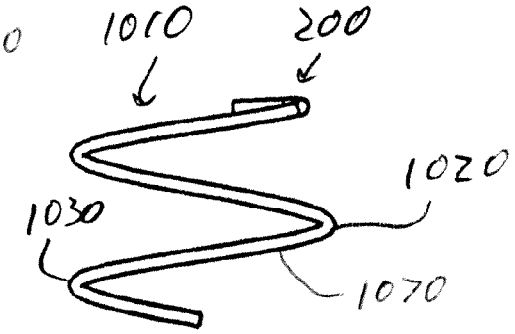
FIG. 18B is a side view of the tenth embodiment of the lamp part fixing device in the second configuration.
Figure 18C:
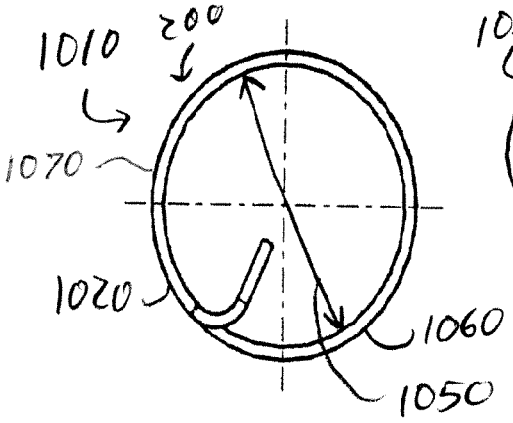
FIG. 18C is a top view of the tenth embodiment of the lamp part fixing device in the second configuration.
Figure 18D:
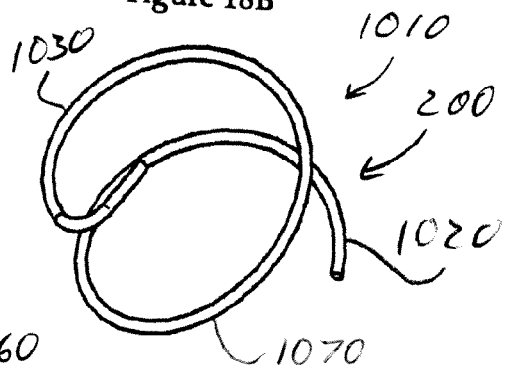
FIG. 18D is a perspective view of the tenth embodiment of the lamp part fixing device in the second configuration.

In a ninth embodiment as shown in FIGS. 15A-16B, a device 910 is illustrated in both a first configuration 100 (FIGS. 15A-B) and a second configuration 200 (FIGS. 16A-B). The device 910 has a generally rectangular-shaped main body 920 dimensioned for receipt into a discharge tube 125. The main body 920 includes a base member 930 and a generally L-shaped articulating member 940 arranged in a generally rectangular shape. The articulating member 940 is shown attached to the base member 930 along a hinge 950. In this embodiment, the base member 930, articulating member 940 and hinge 950 are made from a continuous wire and that is constructed from a shape memory alloy that actuates from the first configuration 100 to the second configuration 200 at a transition temperature. In the first configuration 100, the base member 930 and the articulating member 940 are substantially aligned along a common plane and form a generally rectangular perimeter shape. The device 910 is sized to be freely received within the discharge tube 125. In the second configuration 200, the articulating member 940 is angled or spaced from the base member 930 such that portions of the base member 930 and articulating member 940 abut an inner surface 160 of the discharge tube 125 (shown as having a generally circular shaped cross sectional area. The hinge 950 is located along a length portion 955 of the generally rectangular shaped main body 920 such that the articulating member 940 is located along a width portion 945.

In a tenth embodiment as shown in FIGS. 17A-18D, a device 1010 is illustrated in both the first configuration 100 (FIG. 17A-D) and the second configuration 200 FIGS. 18A-D). The device 1010 is a coiled wire that forms an arcuate peripheral body. More particularly, the coiled body or spring 1020 is preferably made from a continuous wire and has a plurality of turns 1030. The turns 1030 extend at least partially along a circumference 1060 and include a first diameter 1040 (FIG. 17C) in the first configuration 100 and a larger, second diameter 1050 (FIG. 18C) in the second configuration 200. The coiled body 1020 transitions at a transition temperature of the shape memory alloy between the first configuration 100 and the second configuration 200 by modifying a pitch of the turns 1030 (number of turns over an axial length) and preferably enlarging a diameter (or enlarging one or both or minor and major axes of an elliptical-shaped body. In the second configuration 200, an outer edge or edge portions 1070 of the device 1010 abuts the inner surface 160 of the discharge tube 125 along the circumference to immobilize the device 1010 in the discharge tube. Stated another way, positioning and immobilizing is achieved by manufacturing the device of shape memory alloy material.

In this disclosure, lamp parts including main and/or auxiliary amalgams are fixed onto the device or mount and the device is inserted into the fluorescent discharge tube. The shape memory alloy is in its first form in this first configuration or phase, i.e., the peripheral dimensions of the device in the first configuration are small enough for receipt in the discharge tube. After the lamp part is located at a desired position in the discharge tube, the device is fixed in its final position or second configuration. Fixing or immobilizing the device in the second configuration or final position is accomplished or provided by changing the shape or configuration of the device as a result of heating the shape memory alloy material above its transition temperature. The result is an immobilized device with its extended dimensions and the required lamp part is fixed in the discharge tube. It will be appreciated that although it is preferred to form the entire device from the shape memory alloy, it is also contemplated that select portions of the device may be formed from this material without departing from the scope and intent of the present disclosure. Likewise, the main or auxiliary amalgam or getter can be advantageously located at preselected axial locations and/or within a diffusion path between the lamp electrodes.

Figure 19:
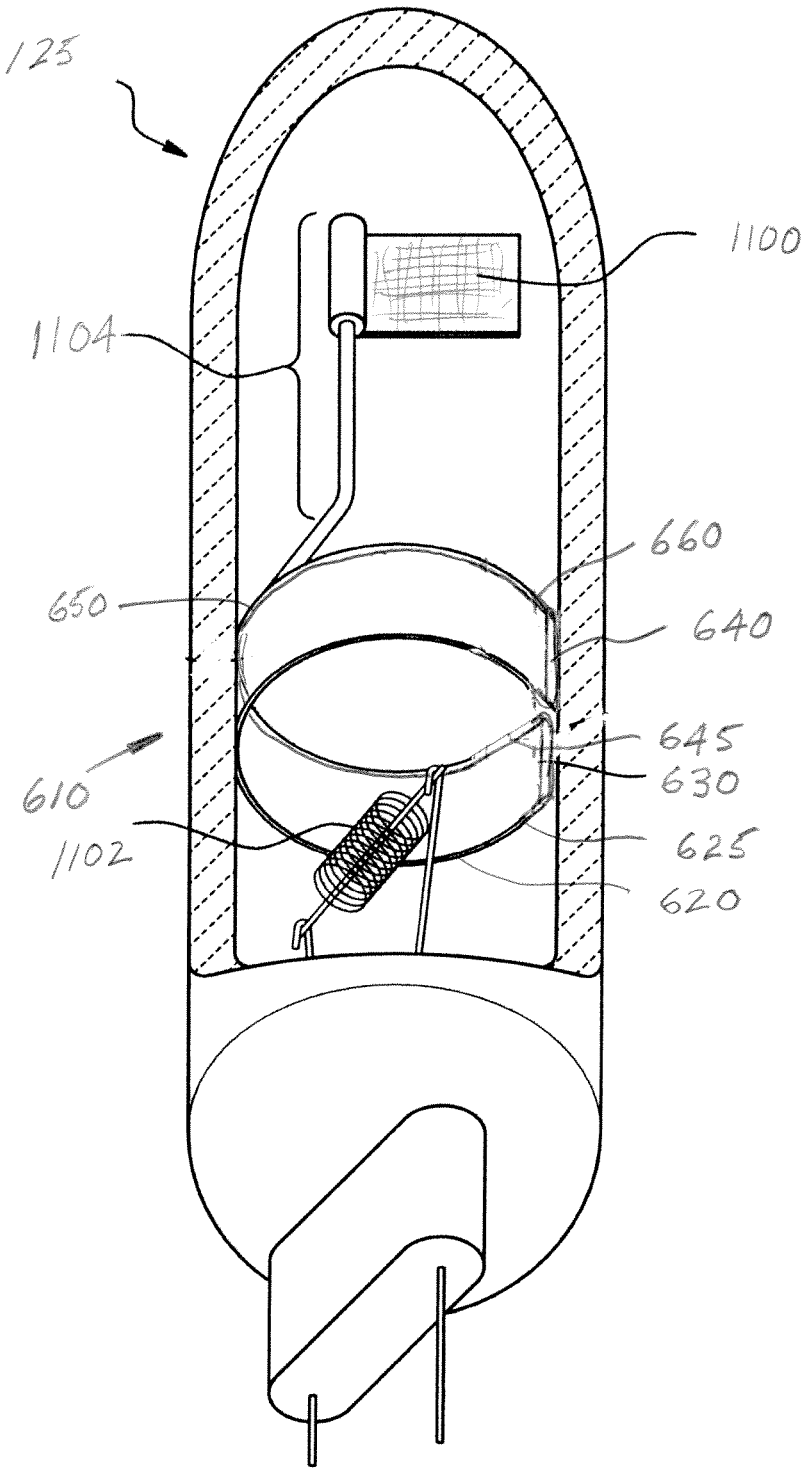
FIG. 19 is a perspective view partially in cross-section of a portion of a fluorescent lamp incorporating the lamp part fixing device of FIGS. 9A-9C and 10A-10C.

FIG. 19 shows one of the lamp part fixing device embodiments (particularly the embodiment of FIGS. 9-10) received in a discharge tube 125 of a fluorescent lamp. Amalgam 1100 is secured to the lamp part fixing device 610 such that first and second ends 630, 640 of the wire-like device are biased outwardly against an inner surface of the tube 125. This secures the device 610 and the amalgam 1100 mounted on the device within the fluorescent lamp 125 at a desired location shown here as adjacent a cathode 1102 of the lamp. In the illustrated arrangement, the amalgam 1100 is situated at one end of a wire-like member 1104 that extends generally axially outward from the fixing device 1104 and toward a central axis of the discharge tube so as to advantageously position the amalgam or auxiliary amalgam within or near the discharge path between the cathodes. The fixing device 610 generally conforms to the inner surface of the discharge tube.

It will be appreciated that the illustrated mesh amalgam 110 is exemplary only and can be fixed or secured on base members, articulating members, protrusions, etc. However, the main or auxiliary amalgam may be mesh-like or a mesh fixed type, or alternately may be a ball-type amalgam that may be more difficult to secure or fix but are also within the scope and intent of the present disclosure. For example, securing a ball-type amalgam may require a secondary holder such as a basket on the shape memory alloy device, or an alternative method of securing. Similarly, getters can adopt a wide variety of forms and be effectively used with the shape memory alloy fixing devices described above. It is contemplated that the amalgam, auxiliary amalgam, or getter would preferably be mechanically fixed (for example, by pressing) between the amalgam (mesh or flags) and the shape memory alloy fixing device. In other instances, welding or soldering can be used, although this may be more difficult since heat applying fixation methods could result in undesirably heating the fixing device too much and reaching the transformation temperature of the shape memory alloy material.

The disclosure has been described with reference to the preferred embodiments. Obviously, modifications and alterations will occur to others upon reading and understanding the preceding detailed description. It is intended that the disclosure be construed as including all such modifications and alterations.

What is claimed is:

1. A discharge lamp assembly comprising:
a discharge tube; and
a lamp part fixing device comprising a main body made at least in part of a shape memory alloy to be immobilized within the discharge tube, the main body includes at least one base member and at least one articulating member operably attached along at least one hinge, the device operably configured in one of a first orientation and a second orientation, whereby the device is configured in the first configuration for relative movement within the discharge tube as the shape memory alloy is below an alloy transition temperature, and configured in the second configuration for immobilization within the discharge tube as the shape memory alloy is above an alloy transition temperature.

2. The lamp assembly according to claim 1 wherein the base member, articulating member and hinge are a continuous wire.

3. The lamp assembly according to claim 1 wherein the base member and the articulating member are positioned along a first plane when configured in the first configuration.

4. The lamp assembly according to claim 1 wherein the base member is positioned along a first plane and the articulating member is positioned along a second plane when the device is configured in the second orientation, the first plane being intersected by the second plane.

5. The lamp assembly according to claim 4 wherein the first plane intersects the second plane along the hinge.

6. The lamp assembly according to claim 1 wherein the main body is an arcuate body.

7. The lamp assembly according to claim 6 wherein the arcuate body includes a plurality of segmented portions, each segmented portion configured to extend along a portion of a circumference.

8. The lamp assembly according to claim 6 wherein the arcuate body is a coiled member made of a wire and including a plurality of turns.

9. A fluorescent lamp assembly comprising:
a discharge tube;
a fixing body made of shape memory alloy to be located within the discharge tube of the fluorescent lamp to position a lamp component therein, a first configuration of the fixing body dimensioned for receipt within the discharge tube when the shape memory alloy has not reached an alloy transition temperature, and a different, second configuration of the device for placement within the discharge tube when the shape memory alloy has been heated above the alloy transition temperature, wherein the fixing body remains in the second configuration once the shape memory alloy cools, the fixing body including a generally planar body having a base member attached to at least one articulating member, the base member and articulating member are positioned along a substantially common plane in the first configuration, the articulating member is moved from the substantially common plane when the device is in the second configuration.

10. The lamp assembly according to claim 9 wherein the planar body is a wire.

11. The lamp assembly of claim 9 further comprising a non-planar body extending along a portion of a circumference, the non-planar body having a first end and a second end, the first end is spaced from the second end substantially along the circumference in the first configuration and the first end is spaced further from the second end substantially along the circumference when the device is in the second configuration.

12. The lamp assembly of claim 11 wherein the non-planar body is a wire.

13. The lamp assembly of claim 9 further comprising a coiled body having a plurality of turns including a first diameter in the first configuration and a different, second diameter greater than the first diameter in the second configuration.

14. The lamp assembly of claim 1 wherein the lamp part fixing device will remain in the second configuration once the lamp part fixing device cools.

15. The lamp assembly of claim 1 wherein the lamp part fixing device includes at least one of a main or auxiliary amalgam, and getters secured thereon before the device is immobilized within the discharge tube.

* * * * *